US008372764B2

(12) United States Patent
Yano et al.

(10) Patent No.: US 8,372,764 B2
(45) **Date of Patent: *Feb. 12, 2013**

(54) FIBER COMPOSITE MATERIAL AND METHOD FOR MANUFACTURING THE SAME

(75) Inventors: Hiroyuki Yano, Kyoto (JP); Masaya Nogi, Kyoto (JP); Kentaro Abe, Kyoto (JP); Shinsuke Ifuku, Kyoto (JP); Noriyuki Shimoji, Kyoto (JP); Yoshiaki Oku, Kyoto (JP); Suguru Okuyama, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 607 days.

This patent is subject to a terminal disclaimer.

(21) Appl. No.: 12/309,402

(22) PCT Filed: Jul. 12, 2007

(86) PCT No.: PCT/JP2007/063905

§ 371 (c)(1),
(2), (4) Date: Feb. 27, 2009

(87) PCT Pub. No.: WO2008/010449

PCT Pub. Date: Jan. 24, 2008

(65) Prior Publication Data

US 2009/0305033 A1 Dec. 10, 2009

(30) Foreign Application Priority Data

Jul. 19, 2006 (JP) ..... 2006-196935

(51) Int. Cl.

| | |
|---|---|
| ***B32B 3/00*** | (2006.01) |
| ***B32B 5/02*** | (2006.01) |
| ***D04H 1/00*** | (2006.01) |
| ***B05D 3/00*** | (2006.01) |
| ***D21H 19/00*** | (2006.01) |

(52) U.S. Cl. ..... 442/59; 442/340; 427/389; 162/134; 162/135

(58) Field of Classification Search ..... 442/59–180; 162/119, 134–137

See application file for complete search history.

(56) References Cited

U.S. PATENT DOCUMENTS 3,855,047 A * 12/1974 Groff ..... 428/220
6,117,545 A * 9/2000 Cavaille et al. ..... 428/357

(Continued)

FOREIGN PATENT DOCUMENTS

CN 1832985 9/2006
EP 1 650 253 4/2006

(Continued)

OTHER PUBLICATIONS

English Abstract of JP 09-207234 published Aug. 12, 1997.
English Abstract of JP 07-156279 published Jun. 20, 1995.
English Abstract of JP 2005-060680 published Mar. 10, 2005.
English Abstract of JP 2006-035647 published Feb. 9, 2006.

(Continued)

*Primary Examiner* — Jennifer A Steele
(74) *Attorney, Agent, or Firm* — Wenderoth, Lind & Ponack, L.L.P.

(57) ABSTRACT

A highly transparent fiber composite material is provided that can be manufactured through a simplified process using reduced amounts of raw materials and that has high flexibility and low thermal expansivity and retains good functionality of the fiber material. The fiber composite material includes: a fiber assembly having an average fiber diameter of 4 to 200 nm and a 50 μm-thick visible light transmittance of 3% or more; and a coating layer that coats and smoothes the surface of the fiber assembly, wherein the fiber composite material has a 50 μm-thick visible light transmittance of 60% or more. With this fiber assembly, the scattering of light caused by the irregularities on the surface can be suppressed by coating the surface with the coating layer to smooth the surface, whereby a highly transparent fiber composite material can be obtained.

17 Claims, 5 Drawing Sheets

U.S. PATENT DOCUMENTS

| | | | | |
|---|---|---|---|---|
| 2004/0077752 | A1 * | 4/2004 | Matsufuji et al. | 524/37 |
| 2006/0182941 | A1 * | 8/2006 | Yano et al. | 428/292.1 |
| 2008/0062366 | A1 * | 3/2008 | Ohtani et al. | 349/122 |

FOREIGN PATENT DOCUMENTS

| | | | |
|---|---|---|---|
| EP | 1650253 | A1 * | 4/2006 |
| JP | 8-120597 | | 5/1996 |
| JP | 2005-60680 | | 3/2005 |
| JP | 2006-123222 | | 5/2006 |
| KR | 10-2006-0052961 | | 5/2006 |
| WO | 2005/012404 | | 2/2005 |

OTHER PUBLICATIONS

Form PCT/IB/338 together with International Preliminary Report on Patentability and translation of PCT Written Opinion mailed Jan. 29, 2009 for International (PCT) Application No. PCT/JP2007/063905 of which the present application is the U.S. National Stage.

International Search Report dated Oct. 16, 2007 in the International (PCT) Application PCT/JP2007/063905 of which the present application is the U.S. National Stage.

* cited by examiner (a)

(b)

(a)

(b)

FIBER COMPOSITE MATERIAL AND METHOD FOR MANUFACTURING THE SAME

TECHNICAL FIELD

This patent application is subject to a joint research agreement between KYOTO UNIVERSITY, ROHM CO., LTD, MITSUBISHI CHEMICAL CORPORATION, HITACHI, LTD. PIONEER CORPORATION, and NIPPON TELEGRAPH AND TELEPHONE CORPORATION.

The claimed invention relates to a fiber composite material and to a method for manufacturing the same. In particular, the invention relates to a highly transparent fiber composite material produced by coating an assembly of fibers (hereinafter a fiber assembly) having fiber diameters less than wavelengths of visible light with a coating layer and to a method for manufacturing the same.

BACKGROUND ART

Generally known fiber composite materials include glass fiber-reinforced resins produced by impregnating glass fibers with the resins. Such glass fiber-reinforced resins are generally opaque. However, Patent Documents 1 and 2 disclose methods for obtaining transparent glass fiber-reinforced resins by matching the refractive index of the matrix resin with the refractive index of the glass fibers impregnated therewith.

Patent Document 3 by the present applicants discloses that a highly transparent fiber composite material can be obtained by impregnating a so-called microfibrillated fiber material with a matrix material. Patent Document 3 proposes that fibers produced by fibrillating and grinding fibers derived from plants, such as pulp, and also bacterial cellulose having a three-dimensional structure and produced from a product containing bacteria and cellulose produced by the bacteria by removing the bacteria therefrom can be used as the microfibrillated fiber material.

[Patent Document 1] Japanese Patent Application Laid-Open No. Hei. 9-207234.

[Patent Document 2] Japanese Patent Application Laid-Open No. Hei. 7-156279.

[Patent Document 3] Japanese Patent Application Laid-Open No. 2005-60680.

DISCLOSURE OF THE INVENTION

Problems to be Solved by the Invention

The conventional glass fiber-reinforced resins disclosed in Patent Documents 1 and 2 may become opaque under some use conditions. Specifically, the refractive index of a material has a temperature dependence. Therefore, although the glass fiber-reinforced resins disclosed in Patent Documents 1 and 2 are transparent under certain temperature conditions, they may become semitransparent or opaque under conditions different from the above temperature conditions. Moreover, the refractive index has a wavelength dependence, which differs from material to material. Therefore, even when the refractive index of fibers is matched with the refractive index of the matrix resin at a specific wavelength in the visible wavelength range, the refractive indices could be different from each other in a certain range within the visible wavelength range. In such a range, the transparency can not be obtained.

In the fiber composite material disclosed in Patent Document 3, cellulose fibers of nanoscale fiber diameters are used so that the fiber diameters are allowed to be smaller than the wavelengths of visible light, and the void spaces between the fibers are impregnated with a matrix material having a refractive index close to that of cellulose. In this manner, scattering of visible light at the interfaces between the fibers and the matrix material in the void spaces is suppressed. Accordingly, a fiber composite material having high transparency that is not influenced by temperature conditions, wavelengths, and the like can be obtained. However, when a fiber material having a high void ratio is impregnated with a matrix material, a large amount of the matrix material must be used. Moreover, the impregnation step takes a relatively long time and tends to be a complicated process. Also, under some impregnation conditions, special treatment such as depressurization or pressurization may be required. In addition, since the fiber materials have high flexibility and low thermal expansivity and are excellent in functionality, they are expected to be used in various application fields. However, in a fiber composite material impregnated with a matrix material, the ratio of the amount of the matrix material to the amount of the fiber material is large. This tends to reduce the flexibility and to increase the thermal expansivity, and disadvantageously the properties intrinsic to the fiber material deteriorate.

In view of the above, it is an object of the present invention to provide a highly transparent fiber composite material that can be manufactured through a simplified process using reduced amounts of raw materials and that has high flexibility and low thermal expansivity and retains good functionality of the fiber material. It is another object of the invention to provide a method for manufacturing the fiber composite material.

Means for Solving the Problems

The present invention has been made to solve the above problems and is characterized by the following features.

A fiber composite material of the present invention includes: a fiber assembly having an average fiber diameter of 4 to 200 nm and a 50 μm-thick visible light transmittance of 3% or more; and a coating layer that coats and smoothes a surface of the fiber assembly, wherein the fiber composite material has a 50 μm-thick visible light transmittance of 60% or more. Preferably, a void ratio of the fiber assembly is 35% or less.

Preferably, in the above-mentioned fiber composite material, the fiber assembly is composed of cellulose fibers. The cellulose fibers are preferably fibers separated from fibers derived from plants. Moreover, the cellulose fibers may be fibers obtained by subjecting the fibers separated from the fibers derived from plants to a fibrillating treatment. In particular, the fibrillating treatment preferably includes a grinding treatment. In addition, in a preferable mode the cellulose fibers are chemically modified and/or physically modified.

Preferably, in the above-mentioned fiber composite material, the coating layer is at least one or a combination of two or more of an organic polymer material, an inorganic polymer material, and a hybrid polymer material of organic and inorganic polymers. The coating layer is preferably a synthetic polymer material having a crystallinity of 10% or less and a glass transition temperature of 110° C. or more. Moreover, the coating layer may further include an inorganic material.

Preferably, in the above-mentioned fiber composite material, a refractive index of the coating layer is 1.4 to 1.7. Moreover, a 50 μm-thick visible light transmittance of the coating layer is preferably 60% or more.

Preferably, a linear thermal expansion coefficient of the above-mentioned fiber composite material is $0.05\times10^{-5}$ to $5\times10^{-5}$ $K^{-1}$.

Preferably, in the above-mentioned fiber composite material, an entire area of the surface of the fiber assembly is coated with the coating layer. Preferably, in the above-mentioned fiber composite material, the surface of the fiber assembly includes an uncoated portion not coated with the coating layer, and the uncoated portion is covered with a covering material.

In one aspect, a method for manufacturing the fiber composite material of the present invention is characterized by: applying a coating liquid material that can form the above-mentioned coating layer to the surface of the above-mentioned fiber assembly; and subsequently curing the coating liquid material. The coating liquid material is preferably one or a combination of two or more selected from a fluid coating material, a fluid raw material for a coating material, a fluid material produced by fluidizing a coating material, a fluid material produced by fluidizing a raw material for a coating material, a solution of a coating material, and a solution of a raw material for a coating material.

In another aspect, a method for manufacturing the fiber composite material of the present invention is characterized by applying a coating-laminating material that can form the above-mentioned coating layer to the surface of the above-mentioned fiber assembly.

Effects of the Invention

According to the present invention, a highly transparent fiber composite material can be provided that can be manufactured through a simplified process using reduced amounts of raw materials and that has high flexibility and low thermal expansivity and retains good functionality of the fiber material. In addition, a method for manufacturing the fiber composite material can be provided.

In the present invention, a surface of a fiber assembly having nanoscale fiber diameters and a light transmittance of a predetermined value or more is coated with a coating layer to smooth the surface. In this manner, scattering of visible light at the surface is suppressed, whereby a highly transparent fiber composite material can be obtained.

The inside of the fiber assembly is not filled with a resin or the like, but instead the surface of the fiber assembly is simply coated with the coating layer such as a resin. Therefore, the amount of the resin or the like used can be reduced, and the cost of the raw materials can be reduced. Moreover, since an application method, a lamination method, or the like may be used as the coating method, the treatment process can be simplified.

A highly transparent fiber composite material can be obtained by simply providing a coating layer on a surface of a fiber assembly without filling the void spaces in the fiber assembly with an additional material. Therefore, the characteristics of the fiber assembly, such as high flexibility and low thermal expansivity, can be effectively exploited.

As described above, the fiber composite material of the present invention is excellent in transparency and the like, has high flexibility and low thermal expansivity, and has excellent functionality obtained through the combination of the fiber assembly and the coating layer. Therefore, the fiber composite material can be preferably used for various applications such as electronics, optics, structural material, and construction material applications.

BEST MODE FOR CARRYING OUT THE INVENTION

Figure 1:
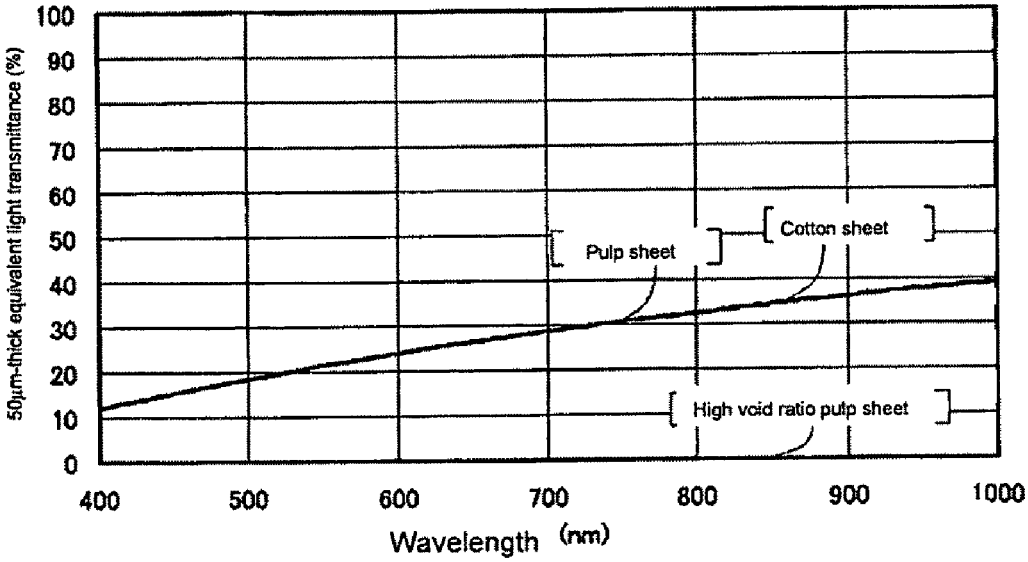
FIG. 1 is a graph showing the 50 μm-thick equivalent light transmittance of a pulp sheet of Manufacturing Example 1, a cotton sheet of Manufacturing Example 2, and a high void ratio pulp sheet of Manufacturing Example 3.

Hereinafter, embodiments of a fiber composite material of the present invention and a method for manufacturing the same will be described in detail with reference to the drawings. It should be noted that the present invention is not limited to the exemplary embodiments described below.

The fiber composite material of the present invention includes: a fiber assembly having an average fiber diameter of 4 to 200 nm and a 50 μm-thick visible light transmittance of 3% or more; and a coating layer that coats and smoothes a surface of the fiber assembly. The fiber composite material is characterized by having a 50 μm-thick visible light transmittance of 60% or more.

In the fiber composite material of the present invention, the surface of the fiber assembly having an average fiber diameter of 4 to 200 nm and a 50 μm-thick visible light transmittance of 3% or more is coated with the coating layer to smooth the surface. In this manner, the scattering of light due to the irregularities on the surface of the fiber assembly can be reduced, whereby high transparency, i.e., a 50 μm-thick visible light transmittance of 60% or more, can be obtained.

In the present invention, high transparency can be obtained by forming the coating layer on the surface of the fiber composite material, and accordingly, the amount of material used for the coating layer can be less than the amount of matrix material used for impregnating a fiber material. Moreover, since an impregnating step is not required, the process can be simplified. In addition, since the coating layer merely covers the surface of the fiber assembly, the coating layer is less likely to impair the characteristics of the fiber assembly. Therefore the excellent characteristics of the fiber assembly, i.e., high flexibility and low thermal expansivity, can be fully exploited.

In the present invention, the "50 μm-thick visible light transmittance" is a 50 μm-thick equivalent value of light transmittance in the wavelength range of 400 to 700 nm. Specifically, the 50 μm-thick visible light transmittance is obtained by: irradiating the fiber composite material of the invention with light having wavelengths of 400 to 700 nm in the thickness direction; measuring light transmittance (linear light transmittance=parallel light transmittance) to average the light transmittance values over the entire wavelength range; and converting the average light transmittance to a value at a thickness of 50 μm. It should be noted that the light transmittance can be determined by disposing a light source and a detector so as to be perpendicular to a test substrate (sample substrate) interposed therebetween and measuring linear transmitted rays (parallel rays) with air as reference. In more detail, the light transmittance can be measured using a measurement method described later in Examples.

Any fiber assembly having an average fiber diameter of 4 to 200 nm and a 50 μm-thick visible light transmittance of 3% or more can be used as the fiber assembly of the present invention. With a fiber assembly satisfying the above requirements, high transparency in the visible range (wavelength: about 400 to about 700 nm) can be obtained by smoothing the surface of the fiber assembly by providing a coating layer.

In the fiber assembly of the present invention, the single fibers may not be oriented in one direction and may form a disordered network structure. In such a case, the average fiber diameter is the average diameter of the single fibers. Moreover, in the fiber assembly of the present invention, a single yarn may be composed of a bundle of a plurality of (a large number of) single fibers. In this case, the average fiber diameter is defined as the average diameter of the single yarns. Bacterial cellulose described later is composed of yarns described above.

No particular limitation is imposed on the shape of the fiber assembly, and the fiber assembly may have various shapes such as sheet-like, plate-like, block-like, and predetermined (for example, lens-like) shapes, so that they can be used in various applications.

The average fiber diameter of the fiber assembly in the present invention is preferably 4 to 200 nm, and more preferably 4 to 60 nm. This average fiber diameter is the average value of the diameters of short fibers or yarn-like fibers constituting the fiber assembly and can be determined by image observation using a scanning electron microscope (SEM) or the like. In the present invention, when the average fiber diameter of the fiber assembly exceeds 200 nm, which is close to the wavelength of visible light, refraction of visible light is more likely to occur at the interfaces with the void spaces, and this may results in a reduction in transparency. Therefore, the upper limit of the average fiber diameter is set to 200 nm. A fiber assembly having an average fiber diameter of less than 4 nm is difficult to produce. For example, the diameter of single fibers of bacterial cellulose described later as an example of the fiber assembly is about 4 nm. Therefore, the lower limit of the average fiber diameter of the fiber assembly in the present invention is set to 4 nm.

The fiber assembly of the present invention may contain fibers having diameters outside the range of 4 to 200 nm, so long as the average fiber diameter falls within the range of 4 to 200 nm. However, in such a case, the ratio of such fibers is preferably 30 percent by weight or less. Moreover, the fiber diameters of all the fibers are preferably 200 nm or less, more preferably 100 nm or less, and most preferably 60 nm or less.

No particular limitation is imposed on the length of the fibers in the fiber assembly, but the average length is preferably 100 nm or more. When the average length of the fibers is less than 100 nm, the reinforcing effect is small, and the strength of the fiber composite material may be insufficient. The fibers may include fibers having lengths of less than 100 nm, but the ratio of such fibers is preferably 30 percent by weight or less.

The 50 μm-thick visible light transmittance of the fiber assembly in the present invention is 3% or more, preferably 5% or more, and more preferably 10% or more. When the 50 μm-thick visible light transmittance of the fiber assembly falls within the above range, a highly transparent fiber composite material having a 50 μm-thick visible light transmittance of 60% or more can be obtained by smoothing the surface of the fiber assembly by providing the coating layer. This is because of the following reason. When the fiber assembly is composed of fibers of nanoscale fiber diameters, the surface irregularities are large, although the inside of the fiber assembly is transparent. A reduction in light transmittance is caused by scattering of light at the surface, but relatively high light transmittance is maintained inside the fiber assembly.

As described above, in the fiber assembly having a transparent inner portion, the reduction in light transmittance is caused by the scattering of light at the surface of the fiber assembly. Therefore, by smoothing the surface by providing the coating layer to suppress the scattering, a highly transparent fiber composite material can be obtained. The present invention is based on the findings as a result of repeated experiments and observations. That is, when the inside of a fiber assembly is relatively transparent and a reduction in light transmittance is caused by scattering at the surface, the fiber assembly allows light to pass therethrough in an amount of about 3% in terms of 50 μm-thick visible light transmittance. However, when the transparency inside the fiber assembly is low, the fiber assembly allows light to pass therethrough only in an amount of less than 3% in terms of 50 μm-thick visible light transmittance. In contrast, when the inside of a fiber assembly is opaque, scattering or reflection of light is caused by the inner voids, the fiber structure, and the like. Therefore, even when the surface is smoothed by a coating layer, such a fiber assembly cannot be made transparent.

If the 50 μm-thick visible light transmittance of the fiber assembly is less than the lower limit value, high transparency may not be obtained even when the surface of the fiber assembly is smoothed by the coating layer. This is because reflection of incident light at the interface between the fiber assembly and the coating layer or scattering of the incident light inside the fiber assembly is caused by the voids inside the fiber assembly, the fiber structure, and the like. No particular limitation is imposed on the upper limit value of the 50 μm-thick visible light transmittance of the fiber assembly, but the upper limit value is 100% or less, and preferably 99% or less. A method for manufacturing a fiber assembly having a light transmittance higher than the above value is complicated, and therefore the cost may increase.

The void ratio of the fiber assembly in the present invention is preferably 35% or less, more preferably 20% or less, and particularly preferably 15% or less. In the present invention, the void ratio can be determined as follows. First, the mass per unit volume of the fiber assembly is measured at 20° C. to determine the density, and the void ratio is determined using the following equation: void ratio (%)=(1−(density of fiber assembly/density of fibers))×100.

When the void ratio of the fiber assembly falls within the above range, the refraction of light at the interfaces between the fibers and voids can be suppressed, and therefore the scattering loss of light caused by the voids in the fiber assembly can be reduced. Moreover, the fiber assembly has nanoscale fiber diameters, which are less than the wavelengths of visible light. Therefore, when the voids are small in size and number, the scattering of visible light can be effectively suppressed. With such a fiber assembly, a highly transparent fiber composite material can be obtained by smoothing the surface by means of the coating layer.

When the void ratio of the fiber assembly exceeds the upper limit value, the voids inside the fiber assembly are large in size and number. In such a case, the influence of light scattering caused by the voids inside the fiber assembly increases, and this causes a reduction in the transparency of the fiber assembly itself. Therefore, even when the surface of the fiber assembly is smoothed by the coating layer, a highly transparent fiber composite material may not be obtained.

No particular limitation is imposed on the lower limit value of the void ratio of the fiber assembly. However, when the number of voids is very small and the fibers are dense, it is difficult to adjust and maintain the fiber diameter within the nanoscale range. Therefore, the lower limit value of the void ratio is 0% or more and preferably 1% or more.

No particular limitation is imposed on the coating layer of the fiber composite material of the present invention, so long as it can cover and smooth the surface of the fiber assembly. The surface irregularities of the fiber assembly are smoothed by the coating layer, and therefore the scattering and reflection of light at the surface are suppressed, whereby a highly transparent fiber composite material can be obtained.

The fiber assembly of the present invention has an average fiber diameter in the nanoscale range and a light transmittance of a predetermined value or more. In such a fiber assembly, although the transparency inside thereof is relatively high, the surface irregularities tend to be large. Therefore, the surface of the fiber assembly is smoothed by the coating layer to flatten the irregularities. In this manner, the surface roughness is reduced, so that the scattering and reflection of light at the surface can be suppressed. As described above, the use of the fiber assembly in combination with the coating layer suppresses the scattering and reflection of light at the surface of the fiber assembly, whereby a highly transparent fiber composite material can be obtained.

The coating layer in the present invention may be formed on the entire surface of the fiber assembly or on a part of the surface of the fiber assembly. For example, when a sheet-like fiber assembly is used, a highly transparent sheet can be obtained by forming the coating layers on both sides of the sheet. When a fiber assembly having a three-dimensional shape such as a block-like shape is used, the coating layers may be formed on all the surfaces of the block or only on opposite surfaces or one surface of the block.

Preferably, all the surfaces of the fiber assembly are coated with the coating layers. In such a case, the coating layers protect the fiber assembly when the fiber composite material is subjected to a wet process or is used under high humidity conditions, and the fiber assembly can be prevented from swelling with water. For example, when a large-size sheet-like fiber assembly coated with the coating layer is cut into small pieces for use, the fiber assembly is exposed at the edge surfaces of the cut small pieces. Therefore, the edge surfaces are preferably coated with the coating layer.

When the surface of the fiber assembly is partially coated with the coating layer, the entire surface of the fiber assembly can be protected by covering the uncoated portion of the surface of the fiber assembly with a covering material. For example, by coating the opposite surfaces of a sheet-like fiber assembly with the coating layer and covering the edges of the sheet with the covering material, transparency can be imparted to the plane of the sheet, and the sheet as a whole can be water resistant. A material which does not smooth the fiber assembly can be used as the covering material, and in this case the manufacturing process can be simplified.

The 50 μm-thick visible light transmittance of the fiber composite material of the present invention is 60% or more, preferably 65% or more, and more preferably 70% or more. When the 50 μm-thick visible light transmittance of the fiber composite material falls within the above range, high transparency to visible light can be obtained. Therefore, the fiber composite material can be used as materials suitable for applications requiring high transparency, such as window materials for movable bodies such as automobiles, electric trains, and ships, displays, houses, buildings, and various optical components. If the 50 μm-thick visible light transmittance of the fiber composite material is less than the lower limit value, the fiber composite material is semi-transparent or opaque, and the range of its applications as a transparent material may be narrowed.

Next, the fiber assembly of the present invention will be described, but the fiber assembly of the invention is not limited to the following description.

Preferably, the fiber assembly of the present invention is composed of cellulose fibers. The cellulose fibers are microfibrils of cellulose that forms base skeletons or the like of plant cell walls or are fibers constituting cellulose. The cellulose fibers are aggregates of filaments having a diameter of typically about 4 nm. The use of cellulose fibers can suppress the thermal expansion of the fiber composite material. Moreover, fiber assemblies having a nanoscale average fiber diameter and a light transmittance of a predetermined value or more can be formed through the use of different types of cellulose fibers described later.

Preferably, the cellulose fibers used in the present invention are nanofibrillated cellulose (or nanofiber cellulose, the term "nanofibrillated cellulose" is used in the following description to include nanofiber cellulose). No particular limitation is imposed on the nanofibrillated cellulose, so long as the average fiber diameter of the cellulose fiber is in the nanoscale range. Examples of the nanofibrillated cellulose include: nanofibrillated fibers obtained by fibrillating cellulose fibers separated from a natural plant such as wood, cotton, or sea grass or the tunic of sea squirt; and bacterial cellulose produced by bacteria. With such nanofibrillated cellulose, a fiber assembly having a small average fiber diameter and a predetermined light transmittance can be obtained.

Examples of the cellulose fibers forming the fiber assembly of the present invention include: fibers separated from plant fibers such as wood, cotton, and fibers separated from vegetable fibers such as the sea grass, fibers separated from animal fibers such as the tunic of sea squirt: and bacterial cellulose, and the fibers separated from plant fibers are preferred. Preferred examples of the plant fibers include pulp, cotton, and wood flour obtained by powdering wood and removing lignin and the like therefrom. Only one type of the cellulose fibers may be used, or a combination of two or more types may be used.

Preferably, the cellulose fibers used in the present invention are produced by subjecting fibers separated from vegetable fibers to fibrillating treatment. Preferred examples of the fibrillating treatment include grinding treatment. The as-separated fibers obtained from plant fibers have relatively large fiber diameters. However, the fibers can be microfibrillated by grinding treatment, and the fiber diameters can thereby be reduced to the nanoscale range. The fiber diameters can be further reduced by microfibrillating the fibers using different treatment before the grinding treatment and then subjecting the resultant fibers having relatively small fiber diameters to the grinding treatment. By forming the fiber assembly using the above fine fibers, the average fiber diameter can be in the nanoscale range, and the light transmittance can be a predetermined value or more. No particular limitation is imposed on the method for shaping the fibers. For example, a method may be used in which the fibers are suspended in water and the suspension is filtrated.

Next, an exemplary method for fibrillating the cellulose fibers will be specifically described. The following exemplary treatment method is applicable not only to the raw materials for the cellulose fibers but also to various fibers originating from pulp, cotton, wood flour, sea grass, tunic of sea squirt, and the like. Only one of the following plurality of processes may be used, or any combination of the processes may be used.

Examples of the method for fibrillating the cellulose fibers in the present invention include grinding treatment. For example, the fibers may be ground using a grinder.

One example of the grinder is a grinder "pure fine mill" manufactured by Kurita Machinery Mfg. Co., Ltd. This grinder is a stone mill type pulverizer that pulverizes a raw material into ultrafine particles by impact, centrifugal force, and shearing force generated when the raw material passes through a space between two vertically disposed grinders. With this grinder, shearing, grinding, size reduction, dispersion, emulsification, and fibrillation can be performed simultaneously.

Another example of the grinder is "Supermasscolloider" manufactured by Masuko Sangyo Co., Ltd. Supermasscolloider is a grinding apparatus capable of producing melt-like ultra fine particles that cannot be obtained by ordinary pulverizing treatment. Supermasscolloider is a stone mill type ultrafine particle grinder including two non-porous grinding stones that are vertically disposed such that the space therebetween can be freely adjusted. The upper grinding stone is fixed, and the lower grinding stone rotates at a high speed. A raw material charged into a hopper is supplied to the space between the upper and lower grinding stones by the centrifugal force and is gradually ground by high compression, shear, and rolling friction forces generated between the grinding stones, whereby ultrafine particles are formed.

An aqueous suspension containing about 0.01 to about 1 percent by weight of the thus-ground fine fibers is prepared and is filtrated, whereby a fiber assembly can be formed.

With the grinding treatment described above, preferable fine fibers can be obtained from the above-described fibers originating from plant fibers. Specifically, when cotton is used, degreased absorbent cotton without further treatment is subjected to grinding treatment, whereby the size of the fibers can be reduced. When wood flour is used, lignin is bleached and removed from powdery wood using sodium chlorite or the like, and hemicellulose is removed using an alkali such as potassium hydroxide. The treated wood flour is then subjected to grinding treatment, whereby fine fibers can be obtained.

In another example of the method for fibrillating the cellulose fibers in the present invention, a combination of the above grinding treatment, beating-pulverizing treatment, and other treatment is used. In this method, before the cellulose fibers are subjected to the grinding treatment, beating and pulverizing are performed by directly applying a force to the fibers so that the fibers are separated from each other and are microfibrillated.

Specifically, this method can be preferably applied to pulp. For example, pulp is treated by a high-pressure homogenizer to obtain microfibrillated cellulose fibers having an average fiber diameter of about 0.1 to about 10 μm, and an aqueous suspension containing about 0.1 to about 3 percent by weight of the microfibrillated cellulose fibers is prepared. Then, to further reduce the size, grinding treatment is performed using the above grinder or the like. In this manner, nanofibrillated cellulose fibers having an average fiber diameter of about 10 to about 100 nm can be obtained. An aqueous suspension containing about 0.01 to about 1 percent by weight of the thus-obtained fibers is prepared and is filtrated, whereby a fiber assembly can be formed.

In another example of the method for fibrillating the cellulose fibers in the present invention, high-temperature high-pressure water vapor treatment is used. In this treatment method, fine cellulose fibers are obtained by subjecting cellulose fibers to high-temperature high-pressure water vapor to separate the fibers from each other.

In this method, the surface of cellulose fibers or the like separated from plant fibers is phosphorylated to weaken the bonding strength between the cellulose fibers. Subsequently, refiner treatment is performed to separate the fibers from each other, whereby cellulose fibers are obtained. For example, fibers separated from plant fibers from which lignin and the like have been removed, the sea grass or the tunic of sea squirt is immersed in a solution containing 50 percent by weight of urea and 32 percent by weight of phosphoric acid, and the cellulose fibers are sufficiently impregnated with the solution at 60° C. Thereafter, the temperature is increased to 180° C. to promote phosphorylation. After washed with water, the product is hydrolyzed in a 3 wt % aqueous hydrochloric acid solution at 60° C. for 2 hours and is again washed with water. Subsequently, the product is treated in a 3 wt % aqueous sodium carbonate solution at room temperature for 20 minutes to terminate phosphorylation. The treated product is fibrillated using a refiner, whereby fine cellulose fibers are obtained. A fiber assembly can be formed by filtrating the obtained aqueous suspension of the cellulose fibers.

In addition to the above-described fibers separated from plant fibers, bacterial cellulose may be used as the cellulose fibers constituting the fiber assembly of the present invention. Since bacterial cellulose has an average fiber diameter corresponding to that of nanofibrillated cellulose, a fiber assembly having a small average fiber diameter and a predetermined light transmittance can be formed therefrom.

Organisms on the earth that can produce cellulose include, in addition to organisms in the plant kingdom, some organisms in the animal kingdom such as sea squirt, some organisms in the Protista such as algae, oomycetes, and myxomycetes, and some organisms in the Monera such as cyanobacteria, acetic acid bacteria, and soil bacteria. At present, the ability to produce cellulose is not found in organisms in the Mycota (Eumycetes). Examples of the acetic acid bacteria include *Acetobacter*. More specific examples include, but not limited to, *Acetobacter aceti, Acetobacter* subsp., and *Acetobacter xylinum*.

By culturing such bacteria, cellulose is produced by the bacteria. The obtained product contains the bacteria and the cellulose fibers (bacterial cellulose) produced by the bacteria and linked with the bacteria. Therefore, after removed from the culture medium, the produce is washed with water or treated with an alkali to remove the bacteria, whereby bacterial cellulose containing water with no bacteria can be obtained. By removing water from the water-containing bacterial cellulose, bacterial cellulose can be obtained.

Examples of the culture medium include agar-like solid culture media and liquid culture media (culture solutions). Examples of the culture solutions include: a culture solution containing 7 percent by weight of coconut milk (the total amount of nitrogen: 0.7 percent by weight, the amount of lipid: 28 percent by weight) and 8 percent by weight of sucrose and having a pH of 3.0 adjusted with acetic acid; and an aqueous solution (SH culture medium) containing 2 percent by weight of glucose, 0.5 percent by weight of Bacto-yeast extract, 0.5 percent by weight of Bacto Peptone, 0.27 percent by weight of disodium hydrogen phosphate, 0.115 percent by weight of citric acid, and 0.1 percent by weight of magnesium sulfate heptahydrate and having a pH of 5.0 adjusted with hydrochloric acid.

For example, the following method can be used as a culture method. Acetic acid bacteria such as *Acetobacter xylinum* FF-88 are inoculated into a coconut milk culture solution. For example, when FF-88 is used, a primary culture solution is obtained after 5 days of incubation in static culture at 30° C. After a gel component is removed from the obtained primary culture solution, the liquid component is added to the same type of culture solution as used above at a ratio of 5 percent by weight, and a secondary culture solution is obtained by after 10 days of incubation in static culture at 30° C. The secondary culture solution contains about 1 percent by weight of cellulose fibers.

In another culture method, an aqueous solution (SH culture solution) is used as the culture solution. The aqueous solution contains 2 percent by weight of glucose, 0.5 percent by weight of Bacto-yeast extract, 0.5 percent by weight of Bacto Peptone, 0.27 percent by weight of disodium hydrogen phosphate, 0.115 percent by weight of citric acid, and 0.1 percent by weight of magnesium sulfate heptahydrate and has a pH of 5.0 adjusted with hydrochloric acid. In this case, the SH culture solution is added to strains of acetic acid bacteria stored in lyophilized form, followed by incubation in static culture for 1 week (25 to 30° C.). Bacterial cellulose is produced on the surface of the culture solution. A portion in which the bacterial cellulose is produced at a relatively large thickness is selected, and a small amount of the culture solution for the strain in the selected portion is removed and added to a new culture solution. Subsequently, this culture solution is placed in a large incubator, followed by incubation in static culture at 25 to 30° C. for 7 to 30 days. As described above, bacterial cellulose can be obtained by repeating the process of "adding a part of an existing culture solution to a new culture solution followed by incubation in static culture for about 7 to 30 days."

If the amount of cellulose produced by the bacteria is insufficient or other problems occur, the following procedure is carried out. Specifically, a small amount of the culture solution in which the bacteria is being cultured is sprayed onto an agar culture medium prepared by adding agar to a culture solution, and the medium is left to stand for about one week to form colonies. The individual colonies are observed, and a colony that produces a relatively large amount of cellulose is removed from the agar culture medium and is added to a new culture solution, followed by incubation.

The bacterial cellulose produced as above is removed from the culture solution, and the bacteria remaining in the bacterial cellulose are removed. Washing with water, alkali treatment, or the like may be used as the removal method. As the alkali treatment for dissolving and removing the bacteria, for example, a method can be used in which bacterial cellulose removed from a culture solution is immersed in an aqueous alkaline solution having an alkali concentration of about 0.01 to about 10 percent by weight for 1 hour or more. When the alkali treatment is carried out, the bacterial cellulose is removed from the alkaline treatment solution and washed well with water to remove the alkaline treatment solution.

Subsequently, the thus-obtained water-containing bacterial cellulose (the water content of the bacterial cellulose is typically 95 to 99 percent by weight) is subjected to dehydration treatment. No particular limitation is imposed on the method for dehydration treatment. For example, a method can be used in which water-containing bacterial cellulose is left to stand or subjected to cold pressing or the like to remove water to some extent and is again left stand or subjected to hot pressing or the like to thoroughly remove the remaining water. Moreover, a method can be used in which, after cold pressing, water is removed using a dryer or by air drying.

The bacterial cellulose obtained in the manner described above can be used as the fiber assembly of the present invention after the average fiber diameter, light transmittance, void ratio, and the like are adjusted based on the culture conditions and the pressurizing, heating, and other conditions during the water removal process performed after incubation. Moreover, dense bacterial cellulose can be obtained by further fibrillating a bacterial cellulose structural body produced by bacteria and again forming into a structural body, whereby a fiber assembly having a predetermined light transmittance can be obtained. With the fiber assembly composed of the above bacterial cellulose, a highly transparent fiber composite material can be obtained by smoothing the surface thereof using a coating layer.

Cellulose fibers obtained by chemically and/or physically modifying the cellulose fibers described above may be used as the cellulose fibers constituting the fiber assembly of the present invention. With such cellulose fibers, the functionality of the fiber assembly can be improved. Examples of the chemical modification include: addition of a functional group such as acetylation, cyanoethylation, acetalization, etherification, and isocyanation; and compounding or coating with an inorganic material such as silicate or titanate through a chemical reaction, a sol-gel method, or the like. For example, as a method for chemical modification, a method can be used in which a fiber assembly is immersed in acetic anhydride and is then heated. Preferably, acetylation is used. In such a case, water-absorbing properties can be reduces, and heat resistance can be improved without a reduction in light transmittance. Examples of the physical modification include coating a surface with metal or ceramic raw material using a physical vapor deposition method (PVD method) such as vacuum deposition, ion plating, and sputtering, a chemical vapor deposition method (CVD method), a plating method such as electroless plating or electrolytic plating, or the like.

Next, a description will be given of the coating layer in the present invention, but the coating layer in the present invention is not limited to the following description.

Preferably, at least one or a combination of two or more of an organic polymer material, an inorganic polymer material, and a hybrid polymer material of organic and inorganic polymers is used as the coating layer in the present invention. When a combination of two or more materials is used, a mixture of the materials may be used to form a single layer, or a plurality of layers composed of different materials may be stacked. When such materials are used, the coating layer can be uniformly formed on the surface of the fiber assembly using a relatively simple process such as application or lamination. In this case, since the surface roughness of the obtained coating layer is small, the reflection at the surface can be suppressed. Therefore high transparency can obtained. Moreover, refraction at the interface between the fiber assembly serving as a substrate and the coating layer can be suppressed by matching the refractive index of the coating layer with that of the fiber assembly. In this manner, a highly transparent fiber composite material can be obtained.

Examples of the organic polymer material used for the coating layer in the present invention include naturally occurring polymer materials and synthetic polymer materials.

Examples of the naturally occurring polymer material include a regenerated cellulose polymer material such as cellophane and triacetyl cellulose. Examples of the synthetic polymer material include a vinyl resin, a resin produced by polycondensation, a resin produced by polyaddition, a resin produced by addition condensation, and a resin produced by ring-opening polymerization.

Examples of the inorganic polymer material used for the coating layer in the present invention include a ceramic such as glass, a silicate material, and a titanate material, and these materials can be formed through, for example, dehydration condensation reaction of alcoholates.

Examples of the hybrid polymer material of organic and inorganic polymers that are used for the coating layer in the present invention include a mixture of the above organic and inorganic polymer materials and a laminate of layers composed of the above organic polymer materials and layers composed of the above inorganic polymer materials.

Next, specific examples of the above synthetic polymer material used as the organic polymer material forming the coating layer are described.

Examples of the vinyl resin include: a general purpose resin such as a polyolefin, a vinyl chloride resin, a vinyl acetate resin, a fluororesin, and a (meth)acrylic resin; and an engineering plastic and a super engineering plastic formed through vinyl polymerization. These resins may be a homopolymer formed from a single type of monomer or may be a copolymer.

Examples of the polyolefin include; a homopolymer or a copolymer of ethylene, propylene, styrene, butadiene, butene, isoprene, chloroprene, isobutylene, isoprene, and the like; and a cyclic polyolefin having a norbornene structure.

Examples of the vinyl chloride resin include a homopolymer or a copolymer of vinyl chloride, vinylidene chloride, and the like.

Examples of the vinyl acetate resin include polyvinyl acetate being a homopolymer of vinyl acetate, polyvinyl alcohol being a hydrolyzed product of polyvinyl acetate, polyvinyl acetal being a reaction product of vinyl acetate with formaldehyde or n-butyl aldehyde, and poly vinyl butyral being a reaction product of polyvinyl alcohol with butyl aldehyde or the like.

Examples of the fluororesin include a homopolymer or a copolymer of tetrachlorethylene, hexafluoropropylene, chlorotrifluoroethylene, vinylidene fluoride, vinyl fluoride, perfluoroalkyl vinyl ether, and the like.

Examples of the (meth)acrylic resin include a homopolymer or a copolymer of (meth)acrylic acid, (meth)acrylonitrile, (meth)acrylates, (meth)acrylamides, and the like. In this specification, the term "(meth)acrylic" means "acrylic and/or methacrylic." Examples of the (meth)acrylic acid include acrylic acid and methacrylic acid. Examples of the (meth) acrylonitrile include acrylonitrile and methacrylonitrile. Examples of the (meth)acrylate include alkyl (meth)acrylates, (meth)acrylic acid-based monomers having a cycloalkyl group, and alkoxyalkyl (meth)acrylates. Examples of the alkyl (meth)acrylate include methyl (meth) acrylate, ethyl(meth)acrylate, butyl(meth)acrylate, 2-ethylhexyl(meth)acrylate, cyclohexyl(meth)acrylate, benzyl (meth)acrylate, lauryl(meth)acrylate, stearyl(meth)acrylate, and hydroxyethyl(meth)acrylate. Examples of the (meth) acrylic acid-based monomer having a cycloalkyl group include cyclohexyl (meth)acrylate and isobornyl(meth)acrylate. Examples of the alkoxyalkyl(meth)acrylate include 2-methoxyethyl(meth)acrylate, 2-ethoxyethyl(meth)acrylate, and 2-butoxyethyl(meth)acrylate. Examples of the (meth)acrylamide include (meth)acrylamide and N-substituted (meth)acrylamides such as N-methyl(meth)acrylamide, N-ethyl(meth)acrylamide, N,N-dimethyl(meth)acrylamide, N,N-diethyl(meth)acrylamide, N-isopropyl(meth)acrylamide, and N-t-octyl(meth)acrylamide.

Examples of the resin produced by polycondensation include an amide resin and a polycarbonate.

Examples of the amide resin include: an aliphatic amide resin such as 6,6-nylon, 6-nylon, 11-nylon, 12-nylon, 4,6-nylon, 6,10-nylon, and 6,12-nylon; and an aromatic polyamide resin produced from an aromatic diamine such as phenylene diamine and an aromatic dicarboxylic acid such as terephthaloyl chloride and isophthaloyl chloride and a derivative thereof.

The above polycarbonate is a reaction product of bisphenols such as bisphenol A and a derivative thereof with phosgene or phenyl dicarbonate.

Examples of the resin produced by polyaddition include an ester resin, a U polymer, a liquid crystal polymer, a polyether ketone, a polyetheretherketone, an unsaturated polyester, an alkyd resin, a polyimide resin, a polysulfone, a polyphenylene sulfide, and a polyether sulfone.

Examples of the ester resin include an aromatic polyester, an aliphatic polyester, and an unsaturated polyester. Examples of the aromatic polyester include a copolymer of a diol described later such as ethylene glycol, propylene glycol, and 1,4-butandiol with an aromatic dicarboxylic acid such as terephthalic acid. Examples of the aliphatic polyester include: a copolymer of a diol described later with an aliphatic dicarboxylic acid such as succinic acid and valeric acid; a homopolymer or a copolymer of a hydroxycarboxylic acid such as glycolic acid and lactic acid; and a copolymer of the above diol, the above aliphatic dicarboxylic acid, and the above hydroxycarboxylic acid. Examples of the unsaturated polyester include a copolymer of a diol described later, an unsaturated dicarboxylic acid such as maleic anhydride, and, if necessary, a vinyl monomer such as styrene.

Examples of the U polymer include a copolymer of a bisphenol such as bisphenol A and a derivative thereof, terephthalic acid, isophthalic acid, and the like.

Examples of the liquid crystal polymer include a copolymer of p-hydroxybenzoic acid with terephthalic acid, p,p'-dioxydiphenol, p-hydroxy-6-naphtoic acid, polyterephthalic ethylene, and the like.

Examples of the polyether ketone include a homopolymer and a copolymer of 4,4'-difluorobenzophenone, 4,4'-dihydrobenzophenone, and the like.

Examples of the polyetheretherketone include a copolymer of 4,4'-difluorobenzophenone and hydroquinone and the like.

Examples of the alkyd resin include a copolymer composed of a higher fatty acid such as stearic acid and palmitic acid, a dibasic acid such as phthalic anhydride, a polyol such as glycerin, and the like.

Examples of the polysulfone include a copolymer of 4,4'-dichlorodiphenyl sulfone, bisphenol A, and the like.

Examples of the polyphenylene sulfide include a copolymer of p-dichlorobenzene, sodium sulfide, and the like.

Examples of the polyether sulfone include a polymer of 4-chloro-4'-hydroxydiphenyl sulfone.

Examples of the polyimide resin include: a pyromellitic acid-type polyimide being a copolymer of pyromellitic anhydride, 4,4'-diaminodiphenyl ether, and the like; a trimellitic acid-type polyimide being a copolymer of trimellitic anhydride chloride, an aromatic diamine such as p-phenylenediamine, a diisocyanate compound described later, and the like; a biphenyl-type polyimide composed of biphenyl tetracarboxylic acid, 4,4'-diaminodiphenyl ether, p-phenylenediamine, and the like; a benzophenone-type polyimide composed of benzophenone tetracarboxylic acid, 4,4'-diaminodiphenyl ether, and the like; and a bismaleimide-type polyimide composed of bismaleimide, 4,4'-diaminodiphenylmethane, and the like.

Examples of the resin produced by polyaddition include a urethane resin.

The urethane resin is a copolymer of a diisocyanate and a diol. Examples of the diisocyanate include dicyclohexylmethane diisocyanate, 1,6-hexamethylene diisocyanate, isophorone diisocyanate, 1,3-cyclohexylene diisocyanate, 1,4-cyclohexylene diisocyanate, 2,4-tolylene diisocyanate, 2,6-tolylene diisocyanate, 4,4'-diphenylmethane diisocyanate, 2,4'-diphenylmethane diisocyanate, and 2,2'-diphenylmethane diisocyanate. Examples of the diol include: a diol having a relatively small molecular weight such as ethylene glycol, propylene glycol, 1,3-propanediol, 1,3-butanediol, 1,4-butanediol, 1,5-pentanediol, 3-methyl-1,5-pentanediol, 1,6-hexanediol, neopentyl glycol, diethylene glycol, trimethylene glycol, triethylene glycol, tetraethylene glycol, dipropylene glycol, tripropylene glycol, and cyclohexanedimethanol; a polyester diol; a polyether diol; and a polycarbonate diol.

Examples of the resin produced by addition condensation include a phenolic resin, a urea resin, and a melamine resin.

Examples of the phenolic resin include a homopolymer or a copolymer of phenol, cresol, resorcinol, phenylphenol, bisphenol A, bisphenol F, and the like.

The above urea resin and melamine resin are a copolymer of formaldehyde, urea, melamine, and the like.

Examples of the resin produced by ring-opening polymerization include a polyalkylene oxide, a polyacetal, and an epoxy resin. Examples of the polyalkylene oxide include a homopolymer or a copolymer of ethylene oxide, propylene oxides, and the like. Examples of the polyacetal include a copolymer of trioxane, formaldehyde, ethylene oxide, and the like. Examples of the epoxy resin include: an aliphatic epoxy resin composed of a polyalcohol such as ethylene glycol and epichlorohydrine; and an aliphatic epoxy resin composed of bisphenol A and epichlorohydrine.

A synthetic polymer material having a degree of crystallinity of 10% or less and preferably 5% or less and having a glass transition temperature (Tg) of 110° C. or more, preferably 120° C. or more, and particularly preferably 130° C. or more is preferably used for the coating layer in the present invention. In order to obtain a fiber composite material excellent in transparency and durability, it is preferable to use such an amorphous synthetic polymer material having a high Tg. When a synthetic polymer material having a Tg of less than 110° C. is used, the coat layer may deform if, for example, it comes into contact with boiling water, and its durability is unsatisfactory in applications as transparent components, optical components, and the like. The Tg can be determined using a DSC method, and the degree of crystallinity can be determined using a density method in which the degree of crystallinity is calculated from the densities of an amorphous portion and a crystalline portion.

In the present invention, the coating layer including any of the above materials may further include am inorganic material. Such a coating layer may be formed by stacking a coating layer including any of the above materials and an inorganic material layer including an inorganic material or may be formed by adding an inorganic material to any of the above materials. When the coating layer includes an inorganic material, the functionality of the coating layer can be improved. Moreover, when an inorganic material layer is formed between the fiber assembly and the coating layer, the material forming the coating layer is prevented from penetrating inside the fiber assembly. Examples of the inorganic material include: silicon oxide; silicon nitride; silicon carbide; silicon oxy nitride; silicon oxy carbide; metal oxides, metal nitrides, and metal carbides such as, alumina, titanium oxide, titanium carbide, titanium oxy nitride; and a mixture thereof. The inorganic material layer can be formed using a chemical vapor deposition method or a physical vapor deposition method. When the inorganic material layer is formed, it is desirable to adjust its thickness to 5 μm or less and preferably 1 μm or less to prevent a reduction in the flexibility of the fiber composite material.

The refractive index of the coating layer in the present invention is preferably 1.4 to 1.7 and more preferably 1.5 to 1.6. Since the refractive index of cellulose being a common fiber is about 1.5, the scattering loss of light at the interface between the fiber assembly and the coating layer can be reduced by adjusting the refractive index of the coating layer to a value close to 1.5 so that the difference in refractive index between the fiber assembly and the coating layer is small. In this manner, a highly transparent fiber composite material can be obtained. When the refractive index of the coating layer is greater than the upper limit value or less than the lower limit value, light is scattered at the interface between the fiber assembly and the coating layer, so that the transparency of the fiber composite material may be reduced.

The 50 μm-thick visible light transmittance of the coating layer in the present invention is preferably 60% or more, more preferably 80% or more, and most preferably 85% or more. In this manner, the transparency of the fiber composite material as a whole, including the coating layer, can be further improved. Among the above various materials for the coating layer, a thermosetting resin such as an acrylic resin, a methacrylic resin, an epoxy resin, a urethane resin, a phenolic resin, a melamine resin, a novolac resin, a urea resin, a guanamine resin, an alkyd resin, an unsaturated polyester resin, a vinyl ester resin, a dially phthalate resin, a silicone resin, a furan resin, a ketone resin, a xylene resin, a thermosetting polyimide, a styrylpyridine-based resin, and a triazine-based resin can be preferably used to form a highly transparent coating layer. Of these, an acrylic resin and a methacrylic resin are preferred because of their particularly high transparency.

The surface roughness Ra (centerline surface roughness) of the coating layer in the present invention needs to be less than the surface roughness Ra of the fiber assembly before the coating layer is formed. Since the surface roughness Ra of the fiber assembly is at least about 2 nm or more, the surface roughness Ra of the coating layer is preferably about 1 nm or less. When the surface roughness Ra falls within the above range, the surface of the coating layer is sufficiently flat, and the scattering of light can be suppressed, so that a highly transparent fiber composite material can be obtained.

The thickness of the coating layer in the present invention is preferably 0.5 μm or more and more preferably 1 μm or more. When the thickness is equal to or greater than the above thickness, the irregularities on the fiber assembly are eliminated, and the surface of the fiber composite material is smoothed, so that the reflection of light is suppressed. In this manner, a highly transparent fiber composite material can be formed.

Next, a method for manufacturing the fiber composite material of the present invention will be described in detail, but the inventive manufacturing method is not limited to the following description.

A method for manufacturing the fiber composite material of the present invention is characterized by applying a coating liquid material capable of forming the above-describe coating layer to the surface of the above-describe fiber assembly, and subsequently curing the applied coating liquid material.

Examples of the application method include: an application method in which a coating liquid material is applied dropwise onto a base material and is spread by a centrifugal force or the like; an application method in which a coating liquid material is spread on a base material using a brush or blade; an application method in which a coating liquid material is spread by spraying or the like it on a base material; and an application method in which a base material is immersed in a coating liquid material and is then removed therefrom such that the base material is not impregnated with the liquid material. Examples of the method that can realize the above application process include a spin coating method, a blade coating method, a wire bar coating method, a spray coating method, and a slit coating method. In particular, in the spin coating method the fiber assembly is rotated, and a fluid coating material is applied dropwise thereonto. The spin coating method is preferred because the centrifugal force allows the coating material to be applied uniformly and thinly to the surface of the fiber assembly.

The coating liquid material in the present invention can be one or a combination of two or more selected from a fluid coating material, a fluid raw material for a coating material, a fluid material produced by fluidizing a coating material, a fluid material produced by fluidizing a raw material for a coating material, a solution of a coating material, and a solution of a raw material for a coating material.

The above fluid coating material is a coating material that has fluidity or the like material. Examples of the fluid raw material for a coating material include a fluid polymerization intermediate such as a prepolymer and an oligomer.

Examples of the fluid material produced by fluidizing a coating material include a material obtained by heating and melting a thermoplastic coating material.

Examples of the fluid material produced by fluidizing a raw material for a coating material include a material obtained by heating and melting a solid polymerization intermediate such as a prepolymer and an oligomer.

Examples of the solution of a coating material and the solution of a raw material for a coating material include a solution prepared by dissolving a coating material or a raw material for a coating material in a solvent and the like. A suitable solvent is selected according to the coating material and the raw material for the coating material to be dissolved. If the solvent is removed by evaporation in a subsequent step, it is preferable to use a solvent having a boiling point equal to or lower than a temperature at which the coating material or the raw material for the coating material is not decomposed.

Preferably, the lower limit of the treatment temperature in the application step is set to a temperature at which the fluidity of the selected type of coating liquid material can be maintained. Preferably, the upper limit of the treatment temperature is set to a temperature equal to or lower than the boiling temperature of the coating liquid material so that deformation does not occur during heating. In particular, when a solvent is used for the coating liquid material, it is preferable that the upper limit of the treatment temperature be equal to or lower than the boiling temperature of the solvent in order to suppress volatilization of the solvent.

The coating liquid material applied to the fiber assembly is cured using a method suitable for the type of the coating liquid material. For example, when the coating liquid material is a fluid coating material, the fluid coating material is cured through crosslinking reaction, chain elongation reaction, or the like. When the coating liquid material is a fluid raw material for a coating material, the fluid raw material is cured through polymerization reaction, crosslinking reaction, chain elongation reaction, or the like.

When the coating liquid material is a fluid material produced by fluidizing a coating material, the fluid material can be cured by cooling or the like. When the coating liquid material is a fluid material produced by fluidizing a raw material for a coating material, a combination of cooling or the like with polymerization reaction, crosslinking reaction, chain elongation reaction, or the like may be used.

When the coating liquid material is a solution of a coating material, the solvent in the solution is removed by, for example, evaporation, air drying, or the like. When the coating liquid material is a solution of a raw material for a coating material, a combination of removal of the solvent in the solution or the like with polymerization reaction, crosslinking reaction, chain elongation reaction, or the like may be used. The removal by evaporation mentioned above includes not only removal by evaporation under normal pressure but also removal by evaporation under reduced pressure.

Another method for manufacturing the fiber composite material of the present invention is characterized by applying a coating-laminating material capable of forming the above-described coating layer to the surface of the above described fiber assembly. For example, a bonding agent or an adhesive agent is applied to one side of a sheet of cellophane being a regenerated cellulose-based polymer material. The cellophane sheet can be applied to the surface of the fiber assembly by pressing the bonding or adhesive surface of the sheet against the surface of the fiber assembly and subjecting them to pressure, photo-curing, heat-curing, or hot melt. Examples of the coating-laminating material include, in addition to the cellophane mentioned above, PET (polyethylene terephthalate), PEN (polyethylene naphthalate), PES (polyether sulfone), PC (polycarbonate), polyolefin, PMMA (polymethylmethacrylate), nylon, and PI (polyimide).

The linear thermal expansion coefficient of the fiber composite material of the present invention is preferably $0.05\times10^{-5}$ to $5\times10^{-5}$ $K^{-1}$, more preferably $0.2\times10^{-5}$ to $2\times10^{-5}$ $K^{-1}$, and most preferably $0.3\times10^{-5}$ to $2\times10^{-5}$ $K^{-1}$. The linear thermal expansion coefficient of the fiber composite material may be less than $0.05\times10^{-5}$ $K^{-1}$. However, in consideration of the linear thermal expansion coefficient of cellulose fibers and the like, such a linear thermal expansion coefficient may be difficult to achieve. When the linear thermal expansion coefficient is greater than $5\times10^{-5}$ $K^{-1}$, the fiber-reinforcing effect cannot be obtained. Therefore, the difference in the linear thermal expansion coefficient between the fiber composite material and glass or metal material may cause problems such as deflection or distortion of window materials and changes in image-forming characteristics and refractive index of optical components at certain ambient temperatures. The linear thermal expansion coefficient used in the present invention is a linear thermal expansion coefficient measured when the fiber reinforced composite material is heated from 20° C. to 150° C., and is a value measured under the conditions specified in ASTM D 696.

The fiber composite material of the present invention includes the coating layer formed on the surface of the fiber assembly, and the fiber assembly is prevented from being impregnated with resin and the like. Therefore, the characteristics of the fiber assembly, such as the bending strength and bending elasticity, are not impaired, and a material having high strength and high flexibility can be obtained.

According to the present invention, a highly transparent fiber composite material having a 50 μm-thick visible light transmittance of 60% or more can be obtained by coating the surface of a fiber assembly having an average fiber diameter of 4 to 200 nm and a 50 μm-thick visible light transmittance of 3% or more with a coating layer to smooth the surface thereof. Specifically, the transparency inside such a fiber assembly is relatively high, but the surface thereof has irregularities. Therefore, light is reflected from the surface by the irregularities, and the overall light transmittance tends to decrease. However, by smoothing the surface by means of the coating layer, a highly transparent fiber composite material can be obtained.

In the present invention, the surface of the fiber assembly is simply coated with the coating layer, without the need to impregnate the void spaces in the fiber assembly with an additional material such as a resin. Therefore, the amount of raw materials used can be reduced, and the treatment process can be simplified.

In the fiber composite material of the present invention, sufficient transparency can be obtained by simply forming the coating layer on the surface of the fiber assembly, without the need to impregnate the void spaces in the fiber assembly with an additional material. Therefore, the characteristics of the fiber assembly, such as high flexibility and low thermal expansivity, can be effectively exploited. Moreover, even when the ambient temperature is changed, problems such as distortion, deformation, and a reduction in accuracy of the shape are less likely to occur. Therefore, the fiber composite material has an improved optical functionality and is useful as an optical material. In addition, since deflection, distortion, deformation, and the like are suppressed, the fiber composite material is also useful as a structural material.

In the fiber composite material of the present invention, cellulose fibers lighter than glass fibers are used, and the specific gravity thereof can be less than that of glass fiber reinforced resins. Therefore, in the application field of glass fiber reinforced resins, if the inventive fiber composite material is used as an alternative to such resins, a reduction in weight can be achieved. Moreover, the fiber composite material of the present invention has a smaller specific gravity than that of a fiber composite material formed by filling the void spaces in the fiber assembly with an additional material. Therefore, a further reduction in weight can be achieved.

In the present invention, if biodegradable cellulose fibers are used as the fiber assembly, the fiber composite material may be treated only according to the treatment method of the coating layer at the time of disposal and therefore is advantageous for disposal and recycling purposes. Since the coating layer can be simply removed from the surface of the fiber assembly, the disposal thereof is easy.

The fiber composite material of the present invention has high transparency, low thermal expansivity, and high flexibility and therefore can be preferably used as a transparent substrate for forming a wiring circuit.

EXAMPLES

Hereinafter, the present invention will be described in more detail by way of Manufacturing Examples, Examples, and Comparative Examples, but the invention is not limited to the following Examples, unless the gist of the invention is changed. Methods for measuring various properties of the fiber composite material are described below.

[50 μm-Thick Visible Light Transmittance]

<Measurement Apparatus>

"UV-4100 spectrophotometer" (solid sample measurement system, product of Hitachi High-Technologies Corporation) was used.

<Measurement Conditions>

A light source mask of 6 mm×6 mm was used.

Photometry was performed by placing a test sample at a position 22 cm away from an opening of an integrating sphere. By placing the sample in the above position, diffuse transmission light is eliminated, and only linear transmission light reaches a photo detecting unit inside the integrating sphere.

No reference sample. Since no reference (reflection caused by the difference in refractive index between the sample and air. When the Fresnel reflection occurs, the linear transmittance cannot be 100%) is used, a loss in transmittance due to the Fresnel reflection occurs.

Scanning speed: 300 nm/min.

Light source: tungsten lamp, deuterium lamp.

Light source switching: 340 nm.

<Computation Method>

The 50 μm-thick visible light transmittance was determined from the average value of 50 μm-equivalent light transmittances at wavelengths of 400 to 700 nm.

[Acquisition of Scanning Electron Microscope Image (SEM Image)]

<Sample Preparation and Measurement Conditions>

Gold was deposited on each sample (deposition thickness: several nm), and the sample was observed under an electron microscope under the following conditions.

Measurement apparatus: JEOL 6700F (product of JEOL Ltd.).

Acceleration voltage: 1.5 kV.

Magnification: 10,000×.

Working distance: 8 mm.

Contrast adjustment: AUTO.

[Average Fiber Diameter]

For each sample, the average fiber diameter of the cellulose fibers was determined from the SEM image of the each sample.

[Void Ratio]

The mass per unit volume of each sample was measured at 20° C. to determine the density, and the void ratio was determined using the equation below. In the Examples, cellulose was used as the fibers, and the density of the fibers was 1.5 g/cm$^3$.

$$\text{Void ratio (\%)}=(1-(\text{density of sample}/\text{density of fibers}))\times 100.$$

[Measurement of Linear Thermal Expansion Coefficient]

The linear thermal expansion coefficient was measured using "TMA/SS6100" (product of Seiko Instrument Inc.) according to a method specified in ASTM D 696 under the following measurement conditions.

<Measurement Conditions>

Temperature rise rate: 5° C./min.

Atmosphere: $N_2$.

Heating temperature: 20 to 150° C.

Load: 3 g.

Number of determinations: 3.

Length of sample: 4×15 mm.

Thickness of sample: different from sample to sample.

Mode: Tensile mode.

[Surface Roughness Ra (Centerline Surface Roughness)]

<Measurement Apparatus and Conditions>

Each sample was evaluated using an atomic force microscope (AFM) under the following conditions.

Measurement apparatus: SPA-400 (product of SII nanotechnology Inc.).

Measurement area: 5 μm×5 μm.

Manufacturing Example 1

Manufacturing of Pulp Sheet

Microfibrillated cellulose originating from pulp (MFC, cellulose obtained by microfibrillating nadelholz bleached kraft pulp (NBKP) in a high pressure homogenizer, average fiber diameter: 1 μm) was used as a raw material and was well stirred in water to thereby prepare 7 kg of a 1 wt % aqueous suspension. The prepared aqueous suspension was made to pass between discs of a grinder ("Pure Fine Mill KMG1-10", product of Kurita Machinery Mfg. Co., Ltd.) from the center to the outside while the discs almost in contact with each other were rotated at 1,200 rpm, and this operation was repeated 10 times.

The pulp nano fibers (average fiber diameter: 60 nm) obtained by the grinding treatment were added to water to prepare a 0.2 wt % aqueous suspension. Subsequently, the aqueous suspension was filtrated with a glass filter to form a sheet. The formed sheet was dried at 55° C., whereby a pulp sheet having a thickness of 40 μm, a density of 1.3 g/cm$^3$, and a void ratio of 13% was obtained.

Manufacturing Example 2

Manufacturing of Cotton Sheet

The same procedure as in Manufacturing Example 1 described above was repeated, except that cotton (absorbent cotton) was used as a raw material, whereby a cotton sheet having a thickness of 40 to 45 μm, a density of 1.4 g/cm$^3$, and a void ratio of 7% was obtained.

Manufacturing Example 3

Manufacturing of High-Void Ratio Pulp Sheet

A pulp sheet was manufactured by the same method as in Manufacturing Example 1 described above, and the as-manufactured pulp sheet containing water was immersed in t-butyl alcohol to replace the full amount of water. The pulp sheet was then freeze dried in a freeze dryer (FDU-2100, DRC-1000, product of EYELA) to completely dehydrate. The obtained dried pulp sheet was subjected to pressing, whereby a high-void ratio pulp sheet having a thickness of 50 μm, a density of 0.9 g/cm$^3$, and a void ratio of 40% was obtained.

Example 1

Cellophane tape sheets (refractive index: 1.5) were applied to both sides of the pulp sheet obtained in Manufacturing Example 1 to form a laminate.

Example 2

Both sides of the cotton sheet obtained in Manufacturing Example 2 were spin-coated with acrylic resin A (ethoxylated bisphenol A diacrylate, refractive index: 1.54), and the resin was cured. The spin coating was performed under the conditions of 1,000 rpm for 10 seconds, 2,000 rpm for 3 seconds, and 5,000 rpm for 45 seconds. A spin coater (1H-D7, product of MIKASA CO., LTD.) was used. The resin was cured by irradiating the resin with ultraviolet light at 20 J/cm$^2$ using a belt conveyer-type UV irradiation apparatus (Fusion F300, LCB benchtop conveyor, product of Fusion Systems Corporation).

Example 3

The same procedure as in Example 2 was repeated, except that acrylic resin B (tricyclodecane dimethacrylate (TCDDMA), refractive index: 1.53) was used as the acrylic resin. Specifically, both sides of the cotton sheet were spin-coated with acrylic resin B, and the resin was cured.

Example 4

SiN layers (refractive index: 1.92) each having a thickness of 300 nm were deposited on both sides of the cotton sheet obtained in Manufacturing Example 2 using a plasma CVD apparatus. Subsequently, both sides of the cotton sheet were spin-coated with acrylic resin A over the SiN layers using the same method as in Example 2, and the resin was cured.

Example 5

The same procedure as in Example 2 was repeated, except that the pulp sheet obtained in Manufacturing Example 1 was used as the sheet. Specifically, both sides of the sheet were spin-coated with acrylic resin A, and the resin was cured.

Comparative Example 1

The cotton sheet obtained in Manufacturing Example 2 was immersed in acrylic resin A under reduced pressure (0.08 MPa) for 12 hours to immerse the sheet with the resin. Subsequently, the sheet was removed and irradiated with ultraviolet light at 20 J/cm$^2$ using the belt conveyer-type UV irradiation apparatus same as that used in Example 2 to cure the resin.

Comparative Example 2

The same procedure as in Comparative Example 1 was repeated, except that acrylic resin B was used as the acrylic resin. Specifically, the cotton sheet was impregnated with acrylic resin B, and the resin was cured.

Comparative Example 3

Both sides of the pulp sheet obtained in Manufacturing Example 3 were spin-coated with acrylic resin A using the same method as in Example 2, and the resin was cured.

Comparative Example 4

Cellophane tape sheets were applied to both sides of the pulp sheet obtained in Manufacturing Example 3 to form a laminate.

Comparative Example 5

The same procedure as in Comparative Example 1 was repeated, except that the pulp sheet obtained in Manufacturing Example 1 was used as the sheet. Specifically, the sheet was impregnated with acrylic resin A, and the resin was cured.

Next, the samples of the above Manufacturing Examples, Examples, and Comparative Examples were evaluated from different points of view.

FIG. 1 is a graph of light transmittance and shows the measurement results of the 50 μm-thick equivalent light transmittance versus wavelength for the pulp sheet of Manufacturing Example 1 (solid line), the cotton sheet of Manufacturing Example 2 (broken line), and the high-void ratio pulp sheet of Manufacturing Example 3 (dotted line). As can be seen from this figure, the light transmittances of the pulp sheet of Manufacturing Example 1 and the cotton sheet of Manufacturing Example 2 were substantially the same and were about 10 to about 30% in the visible range. In the high-void ratio pulp sheet of Manufacturing Example 3, the light transmittance was about 0%, and almost no light passed through the sheet.

The thicknesses, densities, void ratios, and 50 μm-thick visible light transmittances of the sheets obtained in Manufacturing Examples 1 to 3 are summarized in Table 1. The 50 μm-thick visible light transmittance was determined by averaging the 50 μm-equivalent light transmittance values at wavelengths of 400 to 700 nm (the light transmittance was determined in the same manner in the following description).

TABLE 1

| | Sample | Thickness (μm) | Density (g/cm$^3$) | Void ratio (%) | 50 μm-thick visible light transmittance (%) |
|---|---|---|---|---|---|
| Manufacturing Example 1 | Pulp sheet | 40 | 1.3 | 13 | 21.1 |
| Manufacturing Example 2 | Cotton sheet | 40~45 | 1.4 | 7 | 20.6 |
| Manufacturing Example 3 | High void ratio pulp sheet | 50 | 0.9 | 40 | 0 |

As shown in Table 1, in of the pulp sheet of Manufacturing Example 1 and the cotton sheet of Manufacturing Example 2, the void ratios were low, 13% and 7%, respectively. However, in the high-void ratio pulp sheet of Manufacturing Example 3, the void ratio was high, 40%. In consideration of the results of light transmittance, it can be said that the light transmittance tends to increase as the void ratio decreases. This is because, when the void ratio is low, the light entering the sheet is less scattered in the void spaces and passes therethrough, so that a relatively high light transmittance is obtained.

Figure 2:
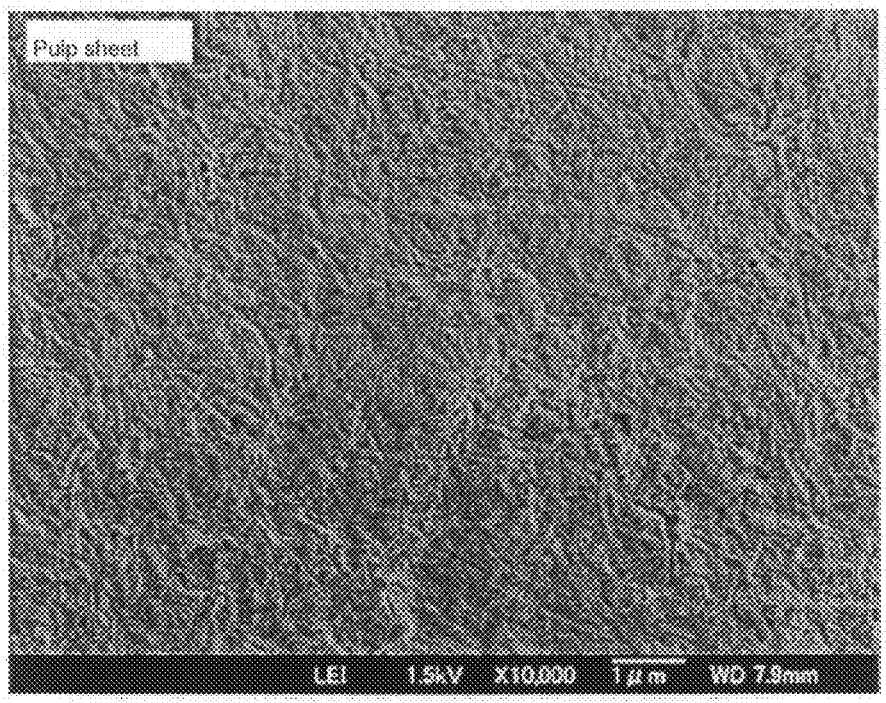
FIG. 2 is a set of SEM images of the pulp sheet of Manufacturing Example 1, (a) being a wide-area image, (b) being an enlarged image.
Figure 2:
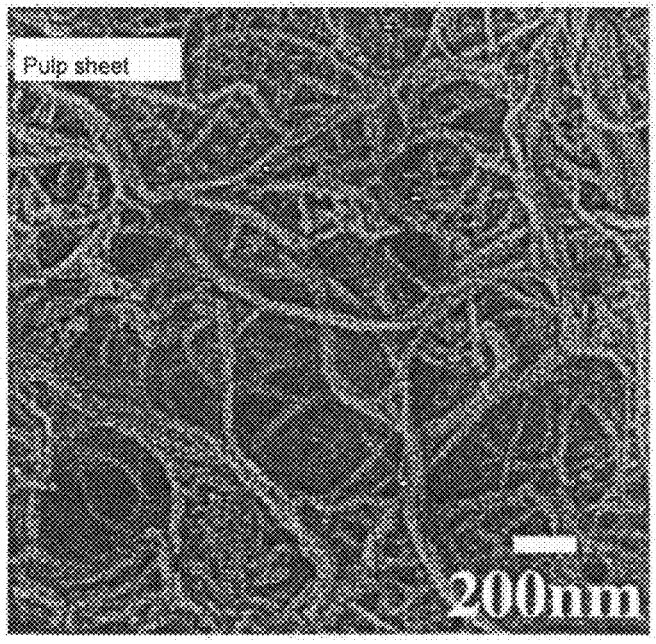
Figure 3:
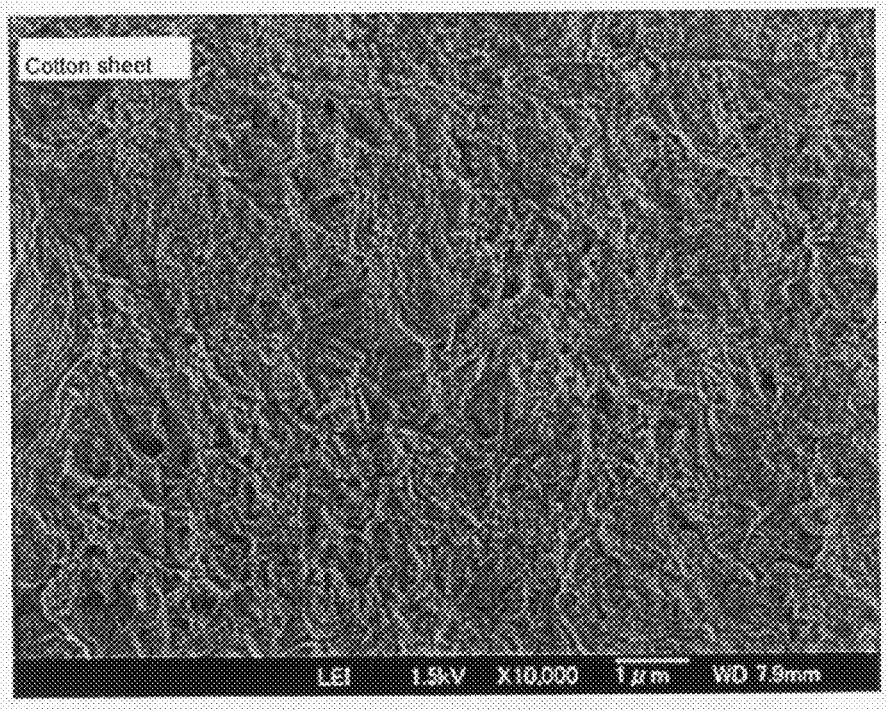
FIG. 3 is a set of SEM images of the cotton sheet of Manufacturing Example 2, (a) being a wide-area image, (b) being an enlarged image.
Figure 3:
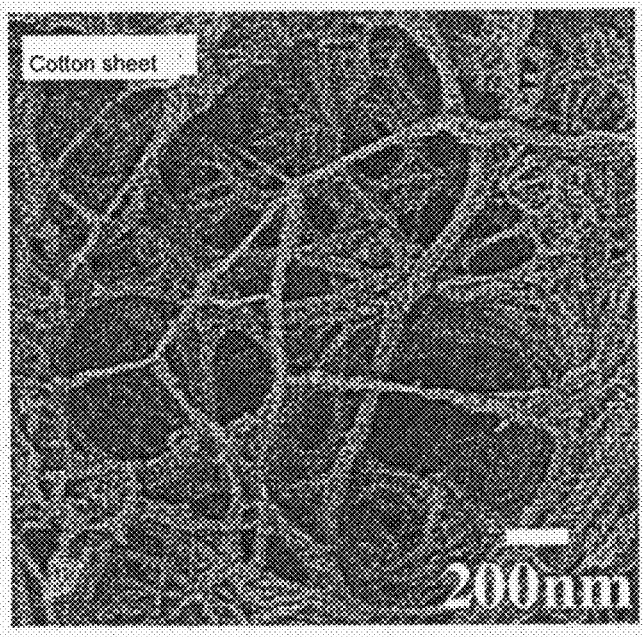

SEM images of the pulp sheet of Manufacturing Example 1 and the cotton sheet of Manufacturing Example 2 are shown in FIGS. 2 and 3, respectively. As can be seen from the wide-area image (a) in each figure, the fibers were densely formed on the surface of each sheet, and the void spaces were small in size and number. As can be seen from the enlarged image (b) in each figure, the average fiber diameter was small and fell within the range of about 4 to about 200 nm.

Next, for each of the samples of the Examples and Comparative Examples, the 50 μm-thick equivalent light transmittance was measured at different wavelengths. The obtained graphs are shown in FIGS. 4 to 7. Moreover, the thicknesses before and after smoothing, thicknesses of the coating layers (one side), and the 50 μm-thick visible light transmittances are summarized in Table 2. The thickness of the coating layer (one side) was determined by dividing the difference between the thicknesses before and after smoothing by 2 (the same method was used in the following description).

TABLE 2

| | Sample | Sheet thickness (μm) before smoothing/ after smoothing | Coating layer thickness (one side) (μm) | 50 μm-thick visible light transmittance (%) |
|---|---|---|---|---|
| Example 1 | Pulp sheet + cellophane tape sheets (both sides laminated) | 40/140 | 50 | 75.4 |
| Example 2 | Cotton sheet + acrylic resin A (both sides spin-coated) | 40/80 | 20 | 78.6 |
| Example 3 | Cotton sheet + acrylic resin B (both sides spin-coated) | 45/70 | 12.5 | 71.9 |
| Example 4 | Cotton sheet + SiN layers + acrylic resin A (both sides spin-coated) | 50/100 | 25 | 72.8 |
| Comparative Example 1 | Cotton sheet + acrylic resin A (impregnation) | — | — | 77.2 |
| Comparative Example 2 | Cotton sheet + acrylic resin B (impregnation) | — | — | 73.2 |
| Comparative Example 3 | High void ratio pulp sheet + acrylic resin A (both sides spin-coated) | 50/70 | 10 | 0 |
| Comparative Example 4 | High void ratio pulp sheet + cellophane tape sheets (both sides laminated) | 50/150 | 50 | 0 |

Figure 4:
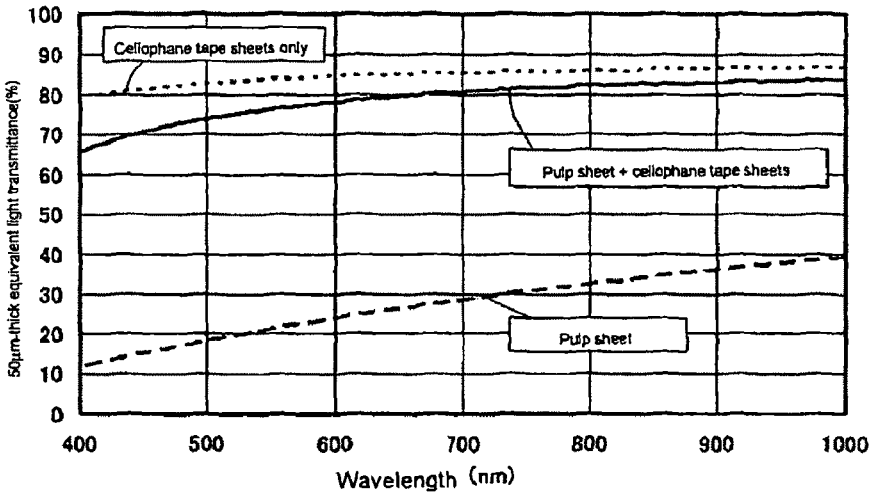
FIG. 4 is a graph showing the 50 μm-thick equivalent light transmittance of a pulp sheet of Example 1 laminated with cellophane tape sheets, the pulp sheet of Manufacturing Example 1, and the cellophane tape sheets only.

FIG. 4 is a graph showing the measurement results of the 50 μm-thick equivalent light transmittance versus wavelength for the pulp sheet of Example 1 laminated with the cellophane tape sheets (solid line), the unlaminated pulp sheet obtained in Manufacturing Example 1 (broken line), and a laminate of only two cellophane tape sheets (thickness: 100 μm, dotted line). As can be seen from this figure, the light transmittance of the pulp sheet laminated with the cellophane tape sheets was higher than that of the unlaminated pulp sheet and was 60% or more in the visible range. This is because the surface of the pulp sheet is smoothed by laminating the pulp sheet with the cellophane tape sheets, so that the scattering of light at the surface is suppressed and the light transmittance increases.

The light transmittance of the cellophane tape sheets only was about 85% at a wavelength of 600 nm, and this is a value due to the transparency and surface roughness of the cellophane tape sheets themselves. The light transmittance of the sheet laminated with the cellophane tape sheets was about 80% at a wavelength of 600 nm and was lower by about 5% than that of the cellophane tape sheets only. Therefore, it can be considered that the light transmittance of a laminated sheet depends on the light transmittance of cellophane tape sheets. Accordingly, the transparency of the laminated sheet can be further improved by using as the coating layer a more transparent resin or the like having a smooth surface.

Figure 5:
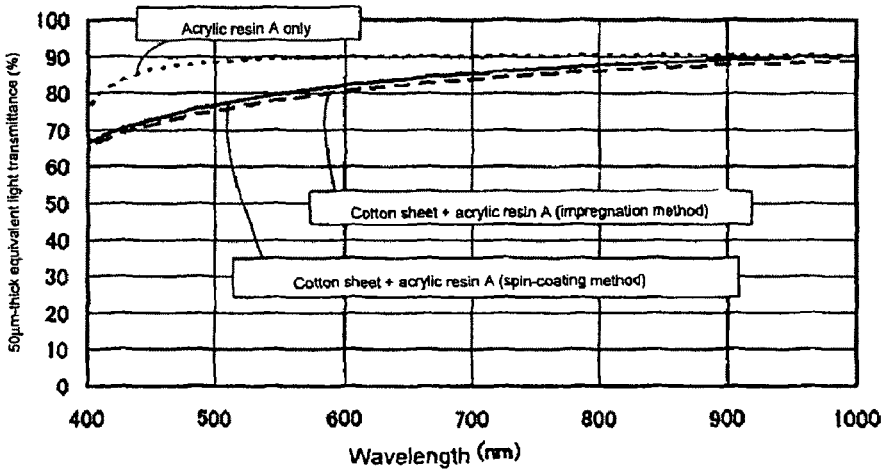
FIG. 5 is a graph showing the 50 μm-thick equivalent light transmittance of a cotton sheet of Example 2 spin-coated with acrylic resin A, a cotton sheet of Comparative Example 1 impregnated with acrylic resin A, and acrylic resin A only.

FIG. 5 is a graph showing the measurement results of the 50 μm-thick equivalent light transmittance versus wavelength for the cotton sheet of Example 2 spin-coated with acrylic resin A (solid line), the cotton sheet of Comparative Example 1 impregnated with acrylic resin A (broken line), and only acrylic resin A having a thickness of 100 μm (dotted line). As can be seen, although the light transmittance of the cotton sheet only was about 10 to about 30% in the visible range (FIG. 1), the light transmittance of the cotton sheet spin-coated with acrylic resin A was 60% or more in the visible range (FIG. 5). This is because the surface of the cotton sheet was smoothed by acrylic resin A. The light transmittance of the spin-coated sheet was slightly higher than that of the impregnated sheet. Therefore, it can be said that the surface smoothing by spin coating can provide transparency substantially the same as that obtained by the impregnation method. Moreover, as in Example 1 above, the transparency of the spin-coated cotton sheet can be further improved by improving the transparency and surface smoothness of the coating resin or the like.

Figure 6:
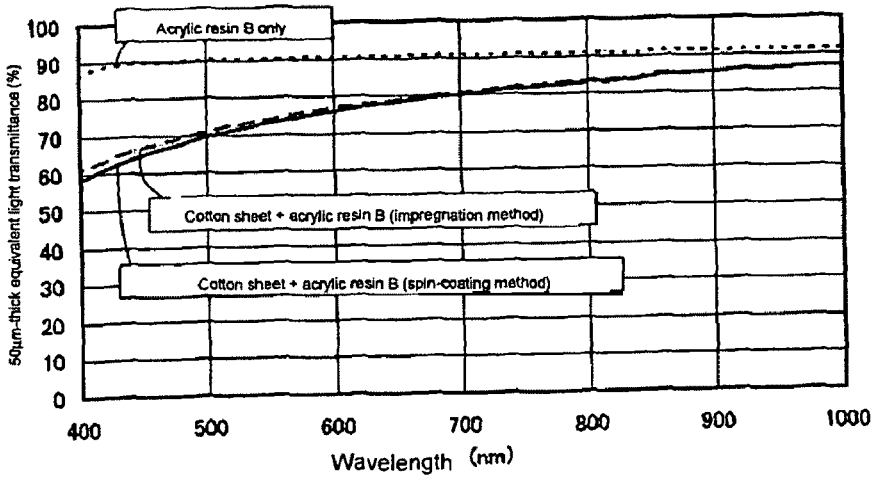
FIG. 6 is a graph showing the 50 μm-thick equivalent light transmittance of a cotton sheet of Example 3 spin-coated with acrylic resin B, a cotton sheet of Comparative Example 2 impregnated with acrylic resin B, and acrylic resin B only.

FIG. 6 is a graph showing the measurement results of the 50 μm-thick equivalent light transmittance versus wavelength for the cotton sheet of Example 3 spin-coated with acrylic resin B (solid line), the cotton sheet of Comparative Example 2 impregnated with acrylic resin B (broken line), and only acrylic resin B having a thickness of 100 μm (dotted line). As can be seen, although the light transmittance of the cotton sheet only was about 10 to about 30% in the visible range (FIG. 1), the light transmittance of the cotton sheet spin-coated with acrylic resin B was 60% or more in the visible range (FIG. 6). This is because the surface of the cotton sheet was smoothed by acrylic resin B. The light transmittance of the spin-coated sheet was substantially the same as that of the impregnated sheet. Therefore, it can be said that the surface smoothing by spin coating can provide transparency substantially the same as that obtained by the impregnation method. Moreover, as in Example 1 above, the transparency of the spin-coated sheet can be further improved by improving the transparency and surface smoothness of the coating resin or the like.

Figure 7:
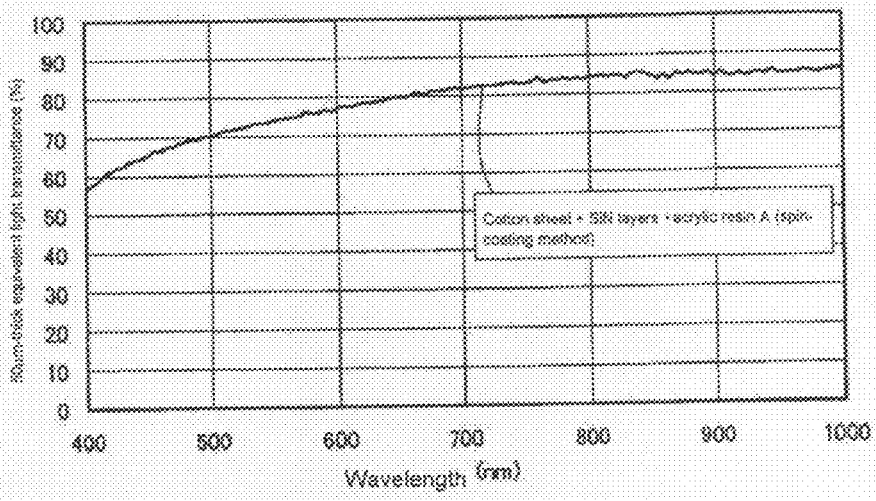
FIG. 7 is a graph showing the 50 μm-thick equivalent light transmittance of a cotton sheet of Example 4 produced by depositing SiN layers and spin-coating the SiN layers with acrylic resin A.

FIG. 7 is a graph showing the measurement results of the 50 μm-thick equivalent light transmittance versus wavelength for the cotton sheet of Example 4 spin-coated with acrylic resin A after the SiN layers were deposited. As can be seen from the figure, the light transmittance of the sheet of Example 4 was 60% or more in the visible range. Therefore, it was found that the transparency of a sheet can be high even when layers composed of an inorganic material, such as SiN layers, are formed. In this Example, the SiN layers are present between the cotton sheet and the coating layers. Therefore, it was found that even when the resin component of the coating layer does not penetrate into the sheet side, a highly transparent sheet can be obtained.

In each of the high-void ratio pulp sheet of Comparative Example 3 spin-coated with acrylic resin A and the high-void ratio pulp sheet of Comparative Example 4 laminated with the cellophane tape sheets, the measured 50 μm equivalent light transmittance was about 0% in the wavelength range of 400 to 1,000 nm, and the 50 μm-thick visible light transmittance was 0% as shown in Table 2. As shown in FIG. 1, the light transmittance of the high-void ratio pulp sheet used in each of Comparative Examples 3 and 4 was about 0%, and almost no light is allowed to pass therethrough. Therefore, it was found that when the light transmittance of a base sheet is low, sufficient transparency cannot be obtained even when the surface of the sheet is smoothed. This is because since the transparency inside the high-void ratio pulp sheet is low due to the void spaces inside the sheet, the inside of the sheet remains opaque even when the surface of the sheet is smoothed, so that transparency cannot be obtained.

Next, the bending strength, bending modulus, and linear thermal expansion coefficient of the sheet obtained in each of Example 5 and Comparative Example 5 were measured, and the results are shown in Table 3.

TABLE 3

| | Sample | Bending strength [MPa] | Bending modulus [GPa] | Linear thermal expansion coefficient [$10^{-6}$/K] |
|---|---|---|---|---|
| Example 5 | Pulp sheet + acrylic resin A (both sides spin-coated) | 208 | 13 | 10 |
| Comparative Example 5 | Pulp sheet + acrylic resin A (impregnation) | 271 | 15 | 14 |

As shown in Table 3, the pulp sheet of Example 5 spin-coated with acrylic resin A had a bending strength of 208 MPa and a bending modulus of 13 GPa. The linear thermal expansion coefficient of this sheet was $10\times10^{-6}$/K, which is sufficiently smaller than the linear thermal expansion coefficient of the acrylic resin itself (about $1.2\times10^{-4}$/K), so that the sheet is a low thermal expansivity sheet. Meanwhile, the pulp sheet of Comparative Example 5 impregnated with acrylic resin A had a bending strength of 271 MPa, a bending modulus of 15 GPa, and a linear thermal expansion coefficient of $14\times10^{-6}$/K. As can be seen from these results, with the coating method, a sheet having higher flexibility and lower thermal expansivity than those of the sheet obtained by the impregnation method can be obtained. This is because since the amount of acrylic resin used relative to the amount of the sheet was small, the characteristics of the sheet can be maintained. In the case of the cotton sheets, as in the case of the pulp sheets, the characteristics of the sheets can be maintained. Moreover, the sheets coated with the resins have transparency similar to that of the sheets impregnated with the resins, as shown in FIGS. 5 to 7. Specifically, by filling only the irregularities on the surface of a sheet with a resin using the coating method to smooth the surface, high transparency can be achieved, and a sheet having high flexibility and low thermal expansivity can be obtained. Accordingly, the sheets of the Examples can be effectively used for applications that require dimensional stability, such as large transparent plates including filters for displays, screens for projection televisions, wiring boards, and frame member materials for movable bodies such as automobiles and electric trains, or for applications, such as large optical components, in which distortion and deformation due to ambient temperature changes result in problems. Moreover, with the impregnating method, it is difficult to reduce the amount of acrylic resin used. However, with the spin coating method, the amount of acrylic resin used can be reduced by reducing the thickness of the coating layer, so long as the surface is smoothed. Therefore, the linear thermal expansion coefficient can be adjusted to a smaller value.

Figure 8:
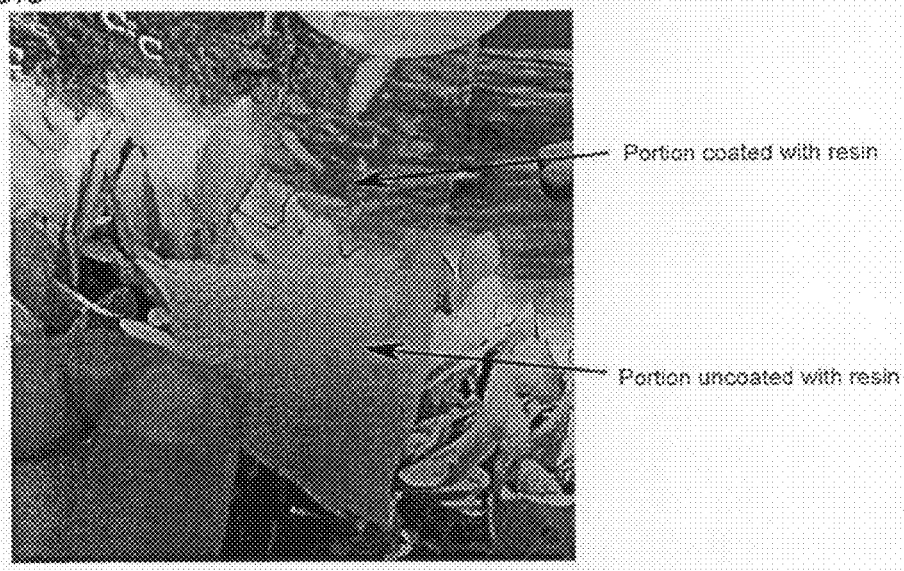
FIG. 8 is a digital image of a sheet produced by coating one half of the pulp sheet of Manufacturing Example 1 with acrylic resin A.

To clarify the fact that the transparency can be improved by coating with a resin, a test was performed in which only one half of the pulp sheet of Manufacturing Example 1 was coated with acrylic resin A. A digital image of the sheet is shown in FIG. 8. As can be seen from FIG. 8, the transparency of the portion coated with acrylic resin A (the upper half of the sheet) was high, so that the background can be clearly observed through the sheet. However, the transparency of the portion not coated with acrylic resin A (the lower part of the sheet) was low, so that the background cannot be observed through the sheet. It is also clear from the above that a highly transparent sheet can be obtained by filling only the irregularities on the surface of a sheet with a resin using the coating method to smooth the surface.

Next, the surface roughnesses Ra (centerline surface roughnesses) of the cotton sheet obtained in Example 2 before and after smoothing are shown in Table 4.

TABLE 4

| Sample | Surface roughness Ra (nm) |
|---|---|
| Cotton sheet (before smoothing) | 6.9 |
| Cotton sheet + acrylic resin A (both sides spin-coated) | 0.92 |

As shown in Table 4, the surface roughness Ra of the cotton sheet before smoothing is 6.9 nm, and the surface roughness Ra of the cotton sheet spin-coated with acrylic resin A is 0.92 nm. Therefore, the surface is smoothed by the coating layer. As described above, the scattering of light at the surface of the cotton sheet can be suppressed by coating the surface with acrylic resin A to smooth the surface, whereby a highly transparent sheet can be obtained.

While the present invention has been described with reference to the specific embodiments, it is apparent to those having ordinary knowledge in the art that various modifications can be made so long as they do not depart from the scope of the present invention. Accordingly, the technical scope of the present invention is not limited to the above-described embodiments but must be defined by the claims and the equivalence thereof.

The invention claimed is:

1. A fiber composite material comprising: an assembly of fibers having an average fiber diameter of 4 to 200 nm, a 50 μm-thick visible light transmittance of 3% or more, a void ratio of 35% or less and one or more void spaces;

and a coating layer that coats and smoothes a surface of the assembly of fibers so as to fill irregularities on the surface of the assembly of fibers, wherein the fiber composite material has a 50 μm-thick visible light transmittance of 60% or more, and wherein at least one of the one or more void spaces is not filled.

2. The fiber composite material according to claim 1, wherein the assembly of fibers is composed of cellulose fibers.

3. The fiber composite material according to claim 2, wherein the cellulose fibers are fibers separated from fibers derived from plants.

4. The fiber composite material according to claim 3, wherein the cellulose fibers are fibers obtained by subjecting the fibers separated from the fibers derived from plants to a fibrillating treatment.

5. The fiber composite material according to claim 4, wherein the fibrillating treatment includes a grinding treatment.

6. The fiber composite material according to claim 2, wherein the cellulose fibers are chemically modified and/or physically modified.

7. The fiber composite material according to claim 1, wherein the coating layer is at least one or a combination of two or more of an organic polymer material, an inorganic polymer material, and a hybrid polymer material of organic and inorganic polymers.

8. The fiber composite material according to claim 7, wherein the coating layer is a synthetic polymer material having a crystallinity of 10% or less and a glass transition temperature of 110° C. or more.

9. The fiber composite material according to claim 7, wherein the coating layer further includes an inorganic material.

10. The fiber composite material according to claim 1, wherein a refractive index of the coating layer is 1.4 to 1.7.

11. The fiber composite material according to claim 1, wherein a 50 μm-thick visible light transmittance of the coating layer is 60% or more.

12. The fiber composite material according to claim 1, wherein an entire area of the surface of the assembly of fibers is coated with the coating layer.

13. The fiber composite material according to claim 1, wherein an edge of the assembly of fibers which is not coated with the coating layer is covered with a covering material.

14. The fiber composite material according to claim 1, wherein a linear thermal expansion coefficient of the fiber composite material is $0.05\times10^{-5}$ to $5\times10^{-5}$ $K^{-1}$.

15. A method for manufacturing the fiber composite material according to claim 1, comprising applying a coating liquid material that can form a coating layer on a surface of a fiber assembly; and subsequently curing the coating liquid material.

16. The method for manufacturing the fiber composite material according to claim 15, wherein the coating liquid material is one or a combination of two or more selected from a fluid coating material, a fluid raw material for a coating material, a fluid material produced by fluidizing a coating material, a fluid material produced by fluidizing a raw material for a coating material, a solution of a coating material, and a solution of a raw material for a coating material.

17. A method for manufacturing the fiber composite material according to claim 1, comprising applying a coating-laminating material that can form a coating layer on the surface of a fiber assembly.

* * * * *